US007789072B2

(12) United States Patent
Morenilla et al.

(10) Patent No.: US 7,789,072 B2
(45) Date of Patent: Sep. 7, 2010

(54) FUEL INJECTION CIRCUIT WITH SELECTABLE PEAK INJECTION CURRENTS

(75) Inventors: Luis Juan Morenilla, Huntsville, AL (US); James Stafford, Huntsville, AL (US); Paul Aaron Markow, Hunstville, AL (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 489 days.

(21) Appl. No.: 11/755,820

(22) Filed: May 31, 2007

(65) Prior Publication Data

US 2007/0278323 A1 Dec. 6, 2007

Related U.S. Application Data

(60) Provisional application No. 60/810,027, filed on Jun. 1, 2006.

(51) Int. Cl.
*F02M 51/06* (2006.01)
*H01H 47/10* (2006.01)

(52) U.S. Cl. ..... 123/490; 361/154

(58) Field of Classification Search ..... 123/472, 123/478, 479, 481, 486, 490; 361/152, 153, 361/154
See application file for complete search history.

(56) References Cited

U.S. PATENT DOCUMENTS

| | | | | |
|---|---|---|---|---|
| 4,604,675 | A * | 8/1986 | Pflederer | 123/490 |
| 4,729,056 | A | 3/1988 | Edwards et al. | |
| 4,736,267 | A * | 4/1988 | Karlmann et al. | 123/490 |
| 5,469,825 | A | 11/1995 | Golab et al. | |
| 6,657,846 | B1 * | 12/2003 | Philipp et al. | 123/490 |
| 7,013,876 | B1 | 3/2006 | Puckett et al. | |
| 7,621,259 | B2 * | 11/2009 | Mayuzumi | 123/490 |
| 2002/0179059 | A1 | 12/2002 | Aoki et al. | |

FOREIGN PATENT DOCUMENTS

| | | |
|---|---|---|
| DE | 10 2005 042530 | 3/2006 |
| EP | 1 072 779 | 1/2001 |

OTHER PUBLICATIONS

International Search Report for PCT Application No. PCT/US2007/070023, Feb. 26, 2008.

* cited by examiner

*Primary Examiner*—Stephen K Cronin
*Assistant Examiner*—Arnold Castro

(57) ABSTRACT

A charging circuit for a fuel injection coil enables the controller to selectively add a pulse of increased amplitude to the beginning of an injection current pulse. Optionally, the controller can also select one of a plurality of amplitudes for the pulse and control the duration of the pulse.

13 Claims, 2 Drawing Sheets

FUEL INJECTION CIRCUIT WITH SELECTABLE PEAK INJECTION CURRENTS

This application claims priority to U.S. Provisional Application Ser. No. 60/810,027, filed Jun. 1, 2006.

BACKGROUND OF THE INVENTION

The present invention relates generally to fuel injection systems for engines.

Known diesel fuel injection systems include a bank of open coils and a bank of close coils. Charging circuits charge the coils to a certain current level and maintain the coil for a certain period of time. Some diesel engines are more difficult to start in very cold weather.

SUMMARY OF THE INVENTION

The present invention provides a circuit for charging coils, particularly suited for a diesel fuel injection system. In an example embodiment of the present invention, the current for some of the coils is increased for a portion of the cycle. An initial pulse is added to the normal charging level of the coils. This provides increased performance during certain conditions, for example, cold weather start-up.

In the example circuitry shown, the level of the pulse is optionally selectable. The controller can select one of a plurality of amplitudes for the pulse.

Optionally, the controller can also control the length of the pulse, by retriggering the pulse. In another optional feature, circuitry for detecting bad coils is modified to accommodate the pulse.

DETAILED DESCRIPTION OF THE PREFERRED EMBODIMENT

Figure 1:
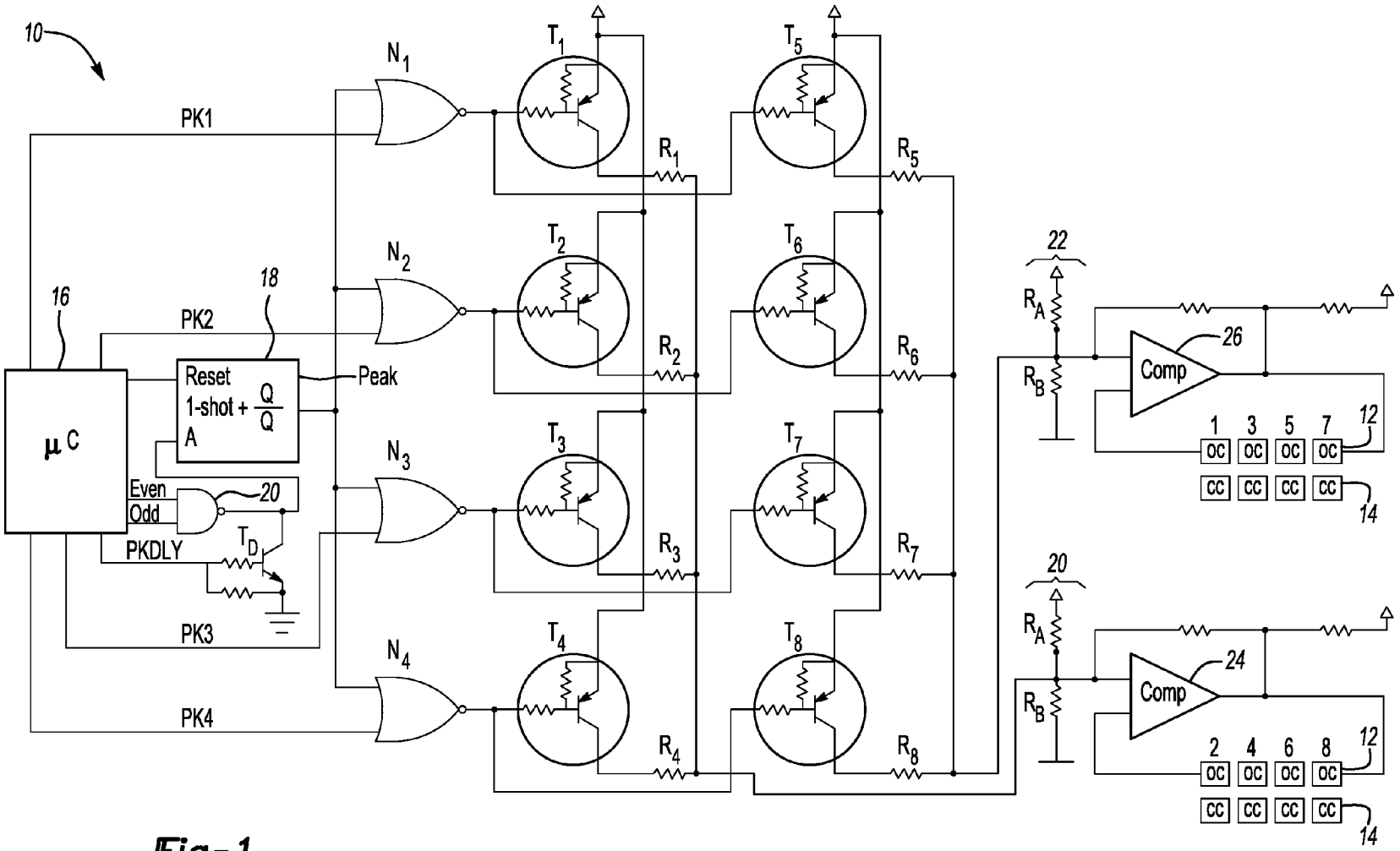
FIG. 1 is a schematic of the fuel injection system according to one embodiment of the present invention.

FIG. 1 is a schematic of an example fuel injection coil charging circuit 10 according to one embodiment of the present invention for charging open coils 12 in a diesel fuel injection system. Corresponding close coils 14 are shown and operate normally. As shown in the schematic of FIG. 1, the inventive feature is applied only to the open coils (even and odd); however, it is possible that it may be desirable to apply the invention to the close coils in certain situations (not shown).

The circuit 10 includes a microcontroller 16 (or other programmable controller or hardware control circuit) suitably programmed to perform normal control functions for the circuit 10 and suitably programmed to perform all of the functions described herein. The circuit 10 further includes a timer, in this example, a one-shot 18. The one-shot 18 is designed to provide a pulse of predetermined length of time when enabled by the microcontroller 16 (i.e. when the microcontroller does not activate the Reset input) and when the one-shot 18 is activated on its input A. The one-shot 18 input is activated by a NAND gate 20 receiving low-active even and odd outputs from the microcontroller 16. The one-shot 18 can also be retriggered by a peak delay signal (PKDLY) from the microcontroller 16 to a transistor $T_D$, which can retrigger the one-shot 18 and restart the timing of the one-shot 18. The one-shot 18 is designed to generate a pulse of a predetermined time. In the example embodiment, that pulse has a time of six hundred microseconds; however, the exact duration can be tailored for the particular application. If additional time is desired in a particular situation, the microcontroller 16 can retrigger the one-shot 18 prior to the end of the first pulse.

The output of the one-shot 18 is connected to four NOR gates $N_1$-$N_4$. The microcontroller 16 has four outputs PK1, PK2, PK3, PK4, each connected to one of the inputs of one of the NOR gates $N_1$-$N_4$. The output of each NOR gate $N_1$-$N_4$ is connected to the base of two transistors $T_1$ and $T_5$, $T_2$ and $T_6$, $T_3$ and $T_7$, $T_4$ and $T_8$ respectively. Each of the transistors $T_1$-$T_8$ has a corresponding resistor $R_1$-$R_8$ which the transistor selectively connects in parallel to Vcc. More particularly, the first four transistors $T_1$-$T_4$ each selectively connect its corresponding resistor $R_1$-$R_4$ in parallel with the other resistors $R_1$-$R_4$. Similarly, the transistors $T_5$-$T_8$ each selectively connect its associated resistor $R_5$-$R_8$ in parallel with the other resistors $R_5$-$R_8$.

The resistors $R_1$-$R_4$ provide a branch of a voltage divider circuit 22 associated with the even open coils 12, while the resistors $R_5$-$R_8$ comprise a branch of a voltage divider circuit 20 associated with the odd open coils 12. The voltage divider circuits 20, 22 each further include resistors $R_A$ and $R_B$, which provide a voltage input to comparators 24, 26, respectively, in driver circuits for the odd and even open coils 12, respectively. The resistors $R_1$-$R_4$ (when activated by their associated transistors $T_1$-$T_4$) are in parallel with resistor $R_A$ in the upper half of the voltage divider circuit 20. The resistors $R_5$-$R_8$ (when activated by their associated transistors $T_5$-$T_8$) are in parallel with resistor $R_A$ in the upper half of the voltage divider circuit 22.

Thus, it can be seen that by selectively turning on or off selective combinations of the transistors $T_1$-$T_4$, selective combinations of the resistors $R_1$-$R_4$ are changing (in this case, raising) the voltage in the voltage divider circuit 22 and, consequently, the resulting voltage input to comparator 24. Similarly, by selectively turning on or off combinations of the transistors $T_5$-$T_8$, selective combinations of the resistors $R_5$-$R_8$ are provided to the voltage divider circuit 20 and selectively provide a voltage level input to the comparator 26. Preferably, although not necessarily, the resistors $R_1$-$R_4$ are all of different values, thus providing sixteen different possible combinations of resistors, and thus, sixteen possible voltage inputs to the comparator 24. Preferably, the resistance values of resistors $R_5$-$R_8$ are equal to $R_1$-$R_4$, respectively. Note that transistors $T_1$ and $T_5$ are turned on and off simultaneously, while transistors $T_2$ and $T_6$ are switched on and off together, as are $T_3/T_7$ and $T_4/T_8$. Thus, the voltage supplied to comparator 26 should be equal to the voltage supplied to the comparator 24.

The comparator 26 will compare the voltage in the odd open coils 12 to the voltage from the voltage divider circuit 22. The comparator 26 will supply current to the odd open coils 12 until their voltage is equal to that of the voltage divider circuit 22. When the voltage on the coils 12 decays, the comparator 26 again supplies current until it is equal to the voltage in the voltage divider circuit 22. If this is a normal cycle, i.e. there is no extra pulse, the transistors $T_5$-$T_8$ will be off and the voltage at the voltage divider circuit 22 at the input to comparator 26 will be the normal amount (for example, sufficient to provide 20 amps to the coils 12).

During some conditions, such as cold weather start-up, the microcontroller 16 selectively activates one or more of outputs PK1-PK4, which will ultimately turn on certain combinations of the transistors $T_1$-$T_8$. For example, by activating lines PK1 and PK2, transistors $T_1$, $T_5$, $T_2$ and $T_6$ will be switched on during the one-shot 18 pulse. This will place resistors $R_1$ and $R_2$ in parallel with resistor RA of voltage divider circuit 20, raising the voltage input to the comparator 24. Simultaneously, this will put resistors $R_5$ and $R_6$ in parallel with resistor $R_A$ in voltage divider circuit 22, raising the voltage input to the comparator 26 to the same level. As will be understood, by selecting different combinations of PK1-PK4, sixteen combinations are possible. If the values of resistors $R_1$-$R_4$ are different (and corresponding resistors $R_5$-$R_8$ are equal to resistors $R_1$-$R_4$), sixteen different voltage levels can be provided at the inputs to comparators 24, 26.

When the pulse from the one-shot 18 is done, all of the NOR gates $N_1$-$N_4$ (whichever combination of PK1-PK4 was active) ensure that all of the transistors $T_1$-$T_8$ are off, thus returning the voltages at the inputs to the comparators 24, 26 to their normal levels. The comparators 24, 26 then let the open coils 12 decay below their normal levels before recharging them up to their normal levels again. Note that there would likely be some hysteresis in the driver circuits.

If a longer pulse is desired, the microcontroller 16 can activate the peak delay (PKDLY) line, switching on transistor $T_D$ to retrigger the one-shot 18 and restart the timing circuit inside the one-shot 18.

Figure 2:
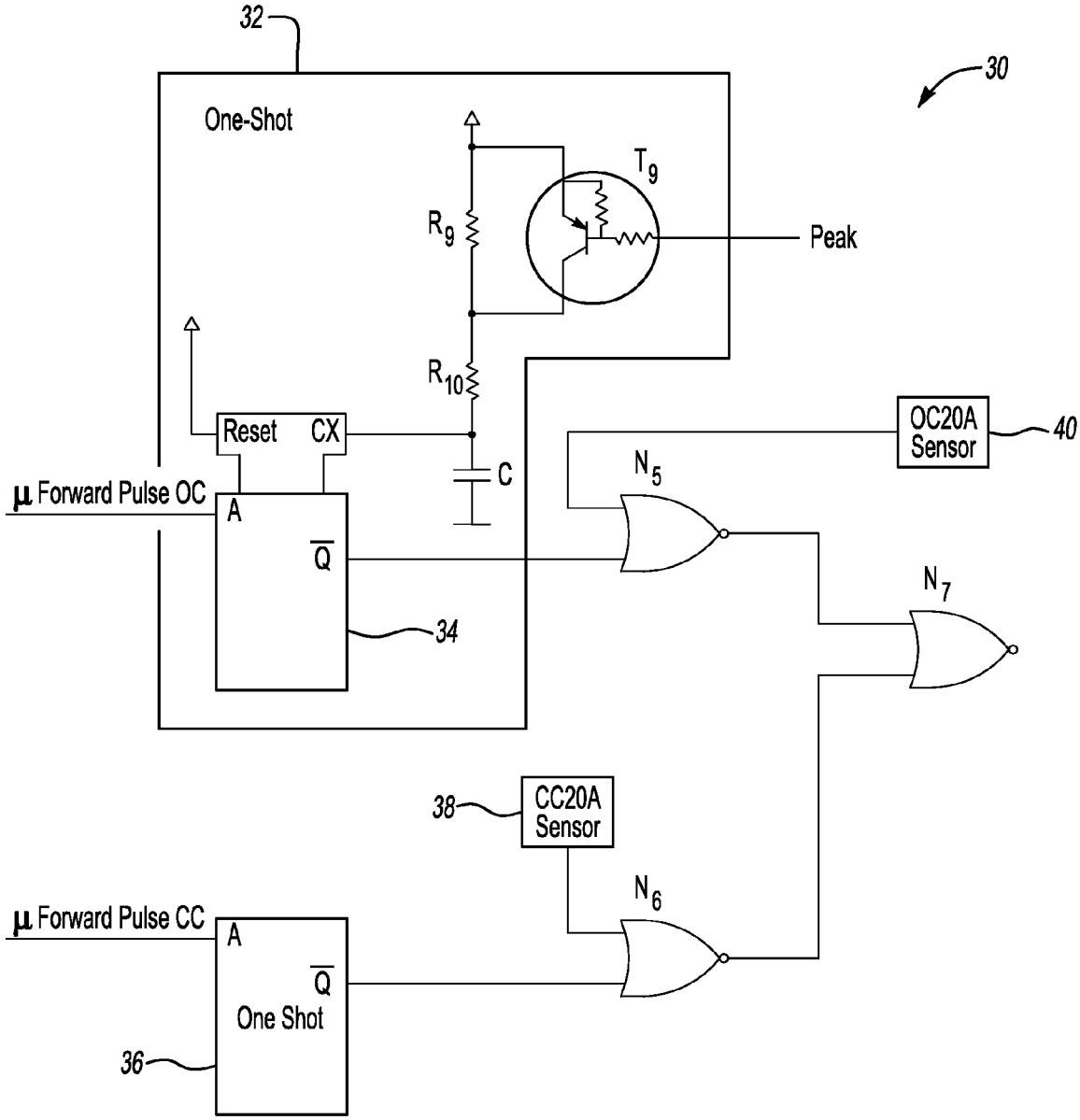
FIG. 2 is a schematic of a circuit for detecting a bad coil in the circuit of FIG. 1.

FIG. 2 is a schematic of a circuit 30 for detecting bad coils 12, 14 (FIG. 1). First, the bad close coil detection circuitry is as is known in the art. The forward pulse close coil signal, which indicates the beginning of a charging cycle, comes from the controller 16 (FIG. 1) and initiates a one-shot 36. The output of the one-shot 36 is connected to an input of a NOR gate $N_6$. A close coil 20 amp sensor 38 (or whatever the normal fully-charged level of the close coils 14 is) sends a signal to the NOR gate $N_6$ when the close coils 14 reach full charge. If the close coil current level does not reach the normal full level before the one-shot 36 is done, the NOR gate $N_6$ goes high. If either (or both) of the inputs to the NOR gate $N_7$ are high, a fault is indicated at the output of the NOR gate $N_7$.

The bad open coil detection circuitry accommodates the pulse that is added at the beginning of the charging cycle. More specifically, the RC circuit inside the one-shot 32 is selectively modified by selectively removing a resistor $R_9$ from the RC circuit with a transistor $T_9$. The transistor $T_9$ is switched off while the one-shot 18 (FIG. 1) is active by the PEAK signal from the one-shot 18 output (FIG. 1). This puts the additional resistor $R_9$ in the RC circuit, thereby decreasing the time of the one-shot 32. Note that the coils 12 are expected to charge to 20 amps (or whatever the normal charging level is) faster when the pulse is added to the beginning of the charging cycle. In the example shown it was determined to be unnecessary to offer sixteen levels of RC timing in the one-shot 32. Instead, a single adjustment of the RC timing circuit is applied any time there is a pulse of any size. Alternatively, various resistor combinations could be added to the RC circuit similar to the way resistor combinations are added to the voltage dividers in FIG. 1.

Although a preferred embodiment has been disclosed, a worker of ordinary skill in this art would recognize that certain modifications would come within the scope of the claims. For that reason, the following claims should be studied to determine their true scope and content.

What is claimed is:

1. A method for charging a fuel injection coil including the steps of:

charging an injection coil at a first level for a first period of time;

charging the injection coil at a second level lower than the first level for a second period of time subsequent to the first period of time; and comparing a level of the coil with a reference and increasing the level of the coil based upon the comparison.

2. The method of claim 1, wherein the second period of time is contiguous with the first period of time.

3. The method of claim 2, further including the step of decreasing the reference from the first time period to the second time period.

4. The method of claim 3, further including the step of selecting the level of the reference from among a plurality of predetermined available levels during the first time period.

5. A method for charging a fuel injection coil including the steps of:

charging an injection coil at a first level for a first period of time charging the injection coil at a second level lower than the first level for a second period of time subsequent to the first period of time and contiguous with the first period of time comparing a level of the coil with a reference and increasing the level of the coil based upon the comparison;

decreasing the reference from the first time period to the second time period;

selecting the level of the reference from among a plurality of predetermined available levels during the first time period; and selectively activating combinations of a plurality of switches to select the level of the reference.

6. A method for charging a fuel injection coil including the steps of:

charging an injector coil at a first level for a first period of time;

charging the injection coil at a second level lower than the first level for a second period of time subsequent to the first period of time and contiguous with the first period of time;

comparing a level of the coil with a reference and increasing the level of the coil based upon the comparison;

decreasing the reference from the first time period to the second time period;

selecting the level of the reference from among a plurality of predetermined available levels during the first time period; and selectively altering a resistance in a voltage divider to select the level of the reference.

7. The method of claim 5, further including the step of selectively extending the first period of time.

8. The method of claim 5, further including the step of determining that the injector coil is faulty based upon a charging time of the injector coil when the injector coil is charged at the first level.

9. The method of claim 6, further including the step of selectively extending the first period of time.

10. The method of claim 6, further including the step of determining that the injector coil is faulty based upon a charging time of the injector coil when the injector coil is charged at the first level.

11. A charging circuit for a fuel injector coil comprising:

a driver for selectively charging the coil at a normal level or at a higher level;

a plurality of switches capable of being activated in multiple combinations by the driver: and a timer generating a pulse for a first period of time, the driver charging the coil at the higher level based upon the pulse and returning to the normal level after the pulse.

12. The charging circuit of claim 11, wherein the driver includes a comparator that compares a charged level of the coil to a reference value, and wherein the pulse alters the reference value for the first period of time.

13. The charging circuit of claim 12, further comprising at least one switch for selectively altering the higher level at which the driver selectively charges the coil.

* * * * *